US007101424B2

(12) United States Patent
Wäscher et al.

(10) Patent No.: US 7,101,424 B2
(45) Date of Patent: Sep. 5, 2006

(54) IONIZER AND USE THEREOF IN AN EXHAUST GAS PURIFYING SYSTEM FOR MOISTURE-LADEN GASES

(75) Inventors: Thomas Wäscher, Heidelberg (DE); Hanns-Rudolf Paur, Karlsruhe (DE); Andrei Bologa, Stutensee (DE); Werner Baumann, Karlsruhe (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 56 days.

(21) Appl. No.: 11/046,640

(22) Filed: Jan. 28, 2005

(65) Prior Publication Data

US 2005/0126392 A1 Jun. 16, 2005

Related U.S. Application Data

(63) Continuation-in-part of application No. PCT/EP03/07818, filed on Jul. 18, 2003.

(30) Foreign Application Priority Data

Sep. 21, 2002 (DE) ..... 102 44 051

(51) Int. Cl.
*B03C 3/41* (2006.01)

(52) U.S. Cl. ..... 96/88; 96/97

(58) Field of Classification Search ..... 96/55, 96/60, 64, 73, 77, 83, 88, 92, 97; 55/DIG. 38
See application file for complete search history.

(56) References Cited

U.S. PATENT DOCUMENTS 1,473,806 A * 11/1923 Bradley ..... 96/28
1,605,648 A * 11/1926 Cooke ..... 95/79
1,992,113 A * 2/1935 Anderson ..... 96/88
2,409,579 A * 10/1946 Meston ..... 96/97
2,505,907 A * 5/1950 Meston ..... 96/97
2,525,347 A * 10/1950 Gilman ..... 95/71
3,765,154 A * 10/1973 Hardt et al. ..... 96/88
3,768,258 A * 10/1973 Smith et al. ..... 60/275
4,194,888 A * 3/1980 Schwab et al. ..... 95/78
4,247,307 A * 1/1981 Chang ..... 95/79
4,449,159 A * 5/1984 Schwab et al. ..... 96/62
4,675,029 A * 6/1987 Norman et al. ..... 95/73
5,254,155 A * 10/1993 Mensi ..... 96/44
6,228,148 B1 * 5/2001 Aaltonen et al. ..... 95/74
6,294,003 B1 * 9/2001 Ray ..... 96/49
6,508,861 B1 * 1/2003 Ray ..... 95/79
6,632,267 B1 * 10/2003 Ilmasti ..... 95/59

(Continued)

FOREIGN PATENT DOCUMENTS

DE 101 32 582 * 8/2002

(Continued)

*Primary Examiner*—Richard L. Chiesa
(74) *Attorney, Agent, or Firm*—Klaus J. Bach

(57) ABSTRACT

In an ionizer of an exhaust gas ionization system for ionizing moisture-laden gases in a channel comprising a nozzle plate having circular nozzle openings through which the gases are conducted, a high voltage electrode support grid arranged downstream of the nozzle plate and having electrode pins extending toward the nozzle openings and carrying at their free ends star structures with a number of tips projecting radially toward the circumference of the nozzle openings and being electrically charged for ionizing the moisture laden gases flowing through the nozzle openings past the star structures, the nozzle openings are sufficiently large to cause the gas flow to be slow enough to permit water to flow down along the walls of the nozzle openings against the upward flow of the gases through the nozzle openings.

8 Claims, 2 Drawing Sheets

U.S. PATENT DOCUMENTS

| | | | | |
|---|---|---|---|---|
| 6,858,064 | B1 * | 2/2005 | Bologa et al. | 95/65 |
| 2004/0139853 | A1 * | 7/2004 | Bologa et al. | 95/64 |

FOREIGN PATENT DOCUMENTS

| | | | | |
|---|---|---|---|---|
| EP | 0 558 090 | 9/1993 | | |
| JP | 53-2767 | * 1/1978 | | 96/60 |
| JP | 09 313981 | 12/1997 | | |
| JP | 2001-198488 | * 7/2001 | | |

* cited by examiner

IONIZER AND USE THEREOF IN AN EXHAUST GAS PURIFYING SYSTEM FOR MOISTURE-LADEN GASES

This is a Continuation-In-Part Application of International Application PCT/EP2003/07818 filed Jul. 18, 2003 and claiming the priority of German application 102 44 051.4 filed Sep. 21, 2002.

BACKGROUND OF THE INVENTION

The invention relates to an ionizer and its use in an exhaust gas purification system for moisture-laden gases.

The ionizer is used for the charging of liquid and solid particles in process gases. In accordance therewith, reference is made in the specification to wet electric filters and dry electric filters.

DE 101 32 582 discloses an apparatus for the electrostatic cleaning of gases, specifically a wet electric filter apparatus. The apparatus is installed in the gas flow channel through which the gas to be cleaned is conducted into the apparatus. When the arrangement was reversed so that the gas flows from the bottom to the top it has been found that a water film is pushed from the bottom nozzle end to the upper nozzle end whereby the flow cross-section is narrowed. As a result, sparking occurs before the high voltage has reached such a value that sufficient ionization current can flow. This effect occurs particularly in connection with condensing and droplet-laden gases at speeds of 3 m/s of the gas flowing from the bottom upwardly through the nozzle. In addition, it has been observed that additionally the negatively charged center electrode pulls the water film floating at the edge practically weightlessly inwardly in the form of a torus which causes arcing.

U.S. Pat. No. 4,449,159 discloses a conical cylinder nozzle, a so-called venturi nozzle which is oriented horizontally and into which an electrode pin is inserted deep into the throat thereof. The electrode pin carries an ionization disc at the circumference of which the corona current flows to the anode by way of the gas. The thicker electrode pin serves at the same time as a focusing electrode.

In U.S. Pat. No. 4,247,307, the vertical spray wires of a wet tube electric filter are provided along the flow direction with serially arranged spray discs. The spray discs may have saw-tooth like structures at their circumference.

U.S. Pat. No. 5,254,155 furthermore discloses a central spray tube arranged in a hexagonal tube and provided with 6-cornered rings whose ends point in the direction of the corners of the hexagonal tube.

JP 200 11 98488 discloses an arrangement wherein alternatively discs and 8-toothed stars are disposed on a central spray wire.

The horizontal venturi nozzle of U.S. Pat. No. 4,449,159 is not suitable for droplet laden moist gas, since a water film is always carried along into the nozzle or, at lower gas speeds, water drips in the throat from the top onto the ionization disc and causes arcing. For a uniform current distribution over the circumference the disc must be accurately adjusted. This is however almost impossible in the hostile operation of the apparatus. Since the electrode pins must be inserted into the nozzle, assembly is expensive. The spray discs of U.S. Pat. No. 4,247,307 are intended to increase the ionization at their circumference whereas the ionization along the wire becomes smaller. By discs arranged in a row along the wire in the flow direction, the particle deposition is to be improved. The discs in connection with the increased ionization in that area however lead to an increased turbulence and renewed transverse mixing which does not improve the fine droplet extraction. If the disc is provided at its circumference with a saw-tooth structure providing for a large number of ionization points, the additional ionization effect is not essential because the equally charged zones located at short distances from one another are mutually repulsive. Furthermore, with respect to the gas flow direction, a serial arrangement of ionization zones is not effective since particles which are already in the vicinity of the wall of the deposition electrode are again entrained by the turbulence and the electrical wind so that, in the end, the probability of particle deposition is not improved.

In U.S. Pat. No. 5,254,155, in place of cylindrical tubes, hexagonal tubes are used together with six-corner rings arranged one after the other in the gas flow direction which cause the same problem.

For JP 200 11 98488, the same arguments apply—the subject matter differs only in that 8-corner stars are used alternatingly with discs.

Experiments have shown that the gas speed in the nozzle can be reduced to values below 3 m/s with a concurrent increase of the diameter and a reduction of the number of nozzles if, at the same time, the electrode is changed from a single point structure to a multi-point structure, for example, a seven point star electrode. If, for example, 1600 cubic meter per hour ($Bm^3$/hr) of wet gas are conducted through 166 conical cylinder nozzles with a diameter of 24 mm an average nozzle gas speed of 5.9 m/sec and a maximum voltage at the electrode of 9 kV and about 30 μA ionization current per nozzle, corresponding to a total current of 5 mA are established. Per $Bm^3$/h of gas only about 0.028 watts of ionizer power can be introduced in this way. Because of the effect of the raising water film as described above, arcing occurs from about 9 kV whereby the ionization is interrupted and the high-voltage power supply is highly strained.

It is the object of the present invention to prevent water films from raising along the nozzle walls.

SUMMARY OF THE INVENTION

In an ionizer of an exhaust gas ionization system for ionizing moisture-laden gases in a channel comprising a nozzle plate having circular nozzle openings through which the gases are conducted, a high voltage electrode support grid arranged downstream of the nozzle plate and having electrode pins extending toward the nozzle openings and carrying at their free ends star structures with a number of tips projecting radially toward the circumference of the nozzle openings and being electrically charged for ionizing the moisture laden gases flowing through the nozzle openings past the star structures, the nozzle openings are sufficiently large to cause the gas flow to be slow enough to permit water to flow down along the walls of the nozzle openings against the upward flow of the gases through the nozzle openings.

The ionizer is of a design in which the gas flows toward the nozzle plate from the bottom and the high voltage electrode with the pins and a star member mounted on each pin is arranged in the gas flow downstream of the nozzle plate that is above the nozzle plate. Such an arrangement is used for gas flows out of boilers, wash columns, filters etc. at a location before the gas enters the exhaust. The parallel circular ionization nozzles through which the gas flows from the bottom to the top have such a diameter that the gas speed remains under 4 m/sec, preferably however under 3 m/sec.

The height of an ionization nozzle is not essentially larger than the thickness of the nozzle plate, for simplicity reasons however preferably exactly as large as the thickness of the nozzle plate. Except for a circumferential chamfer or rounded edges, the nozzle is not profiled in the flow direction. The electrode is arranged above the nozzle that is downstream of the nozzle. The lowest point of the electrode is still above the highest point of the nozzle.

At its lower end, the electrode is star-like shaped wherein the star tips projecting toward the nozzle circumference extend at their ends horizontally or inclined downwardly. The number of such tips is greater than 1 and is preferably an uneven number. The number of tips is determined such that the ionization voltage is so large that per cubic meter of gas flow per hour through the nozzle an electric power of 0.01 to 0.5, preferably 0.05 to 0.3 watts is consumed. The distance of the tips from the nozzle edge is determined by the stable ionization voltage which results from the type of gas, the absolute pressure and the absolute temperature (see description of the particular embodiment, there the distance is 15 mm for exhaust gases with ca. 50 vol % water vapors at 75° C. and 1000 mbar and 13 kV).

In order to further reduce water deposition on the nozzle plate, small vertical discharge tubes are inserted in bores arranged in the nozzle plate at the center points between every three adjacent nozzles. The small tubes extend downwardly from the bottom of the nozzle plate for a length of 1 to 10 times of the plate thickness. The water collection area of the small tubes at the top side of the nozzle plate is increased by providing a 5–30° funnel-like chamfer. The small tube consists preferably of a smooth plastic material with little wall adhesion for water, for example, of polytetrafluorethylene, PTFE.

With this arrangement and a gas flow from the bottom to the top reaching first the nozzle plate and then the electrodes disposed above the nozzle plate, it is prevented that larger water volumes, the so-called droplet swell drop from above onto the ionizer stage and cause short circuits. With the gas flow opposite to the gravity forces only smaller droplet formations which are carried along by the gas flow can reach the nozzle plate but even of those a larger part is deposited already at the nozzle plate and conducted downwardly.

While with a gas flow from the top to the bottom minimized drops can fall onto the nozzle plate, in an upward flow arrangement at the mostly used channel gas speeds of 0.5–2 m/sec only droplets of a maximum size of about 0.1–0.3 mm reach the nozzle plate.

With the reduced gas flow speed in the enlarged nozzle, no water film is pushed upwardly at the inner edge of nozzle, is collected and then sucked inwardly.

Conventionally, each nozzle was provided only with an electrode having a single ionization tip. Now, the nozzle is provided with a central electrode with tips directed star-like toward the nozzle edge. This permits an operation of the nozzle with an increased gas flow volume and with gases, which are difficult to ionize such as air-water vapor mixtures, in such a way that the energy required for the particle charge can still be provided.

At the end of the central electrode, the electrode star may be mounted such that it is exchangeable. If, for changed operating conditions, for example different temperatures, pressures and gas compositions, the number of tips must be adapted it is sufficient only to exchange the electrode stars. In connection with electrodes having a single tip, it was necessary to exchange the whole electrode and also to change the number of nozzles.

The nozzle no longer needs to be cut out of a thick plate or assembled from cylindrical, separately manufactured parts, but it is sufficient to provide the nozzle in a relatively thin metal plate into which the nozzle can be bored or cut by a water jet and provided with a chamfer or with rounded edges. Since the nozzles are not provided with circumferential bulges, liquid collected at the top of the nozzle plate can simply flow down through the nozzle.

The central electrodes are disposed above the nozzles such that the lowest points thereof are still about 3–6 mm above the top edge of a nozzle. Therefore, the nozzle plate can be pulled horizontally out of the apparatus below the grid plate on which the electrodes are supported which substantially facilitates the installation and removal of the nozzle plate.

The centering adjustment tolerance of the electrode is increased by the increased diameter of the nozzle which is advantageous particularly in connection with large nozzle plates. Deposits at the nozzle edges result in a smaller relative distortion of the current-voltage performance line because of the larger nozzle diameter.

The small drain tubes inserted in the bores arranged centrally between every three nozzle openings ensure that liquid collected on the nozzle plate is also drained. The inner diameter of the small tube is so selected that no essential gas volume flows in a short circuit through the small tubes, but on the other hand, water collected on the nozzle plate can freely drain. At the bottom side of the nozzle plate from which the small drain pipes extend water droplets collected at the bottom side will run down along the drain tubes and drop down.

The ionizer is used in the flow channel of a filter apparatus together with a tube bundle separator in such a way that it is arranged upstream of the separator. The gas or air electrically charged in the ionizer for cleaning flows, after passing through the ionizer into the conically-shaped face areas of the tube bundle separator. The tube bundle separator is arranged consequently above the ionizer and has the conical, concise or convex in-flow face area in order to conduct the water removed in the separator to flow down the face toward the outside wall or toward the center from where it can be conducted away and does not drop onto the ionizer which would detrimentally affect its electrical properties or even damage the ionizer.

In addition to cleaning moist air and gas from drying processes and exhaust gases from combustion processes, the ionizer provides also for the cleaning of moist gas containing droplets which are naturally contained therein or which are added wherein water is added to the gas to be cleaned as a result of the preceding use of the gas or it is added by spraying it into the flow channel via spray nozzles. Such a filter arrangement cleans and washes consequently gas or air which contains gaseous contaminants such as HCl, $SO_2$, $SO_3$, $NO_x$.

A particular embodiment of the invention will be described below on the basis of the accompanying drawings.

DESCRIPTION OF A PREFERRED EMBODIMENT

The installation of the ionizer is mechanically and as far as the insulation arrangement is concerned the same as shown in DE 101 32 582.

The selection of the material for the electrodes depends on the gas to be processed and the components contained therein as well as the chemical reaction properties thereof. The material may for example be copper or brass possibly coated with a protective metal or stainless steel, titanium or a titanium alloy.

Figure 2:
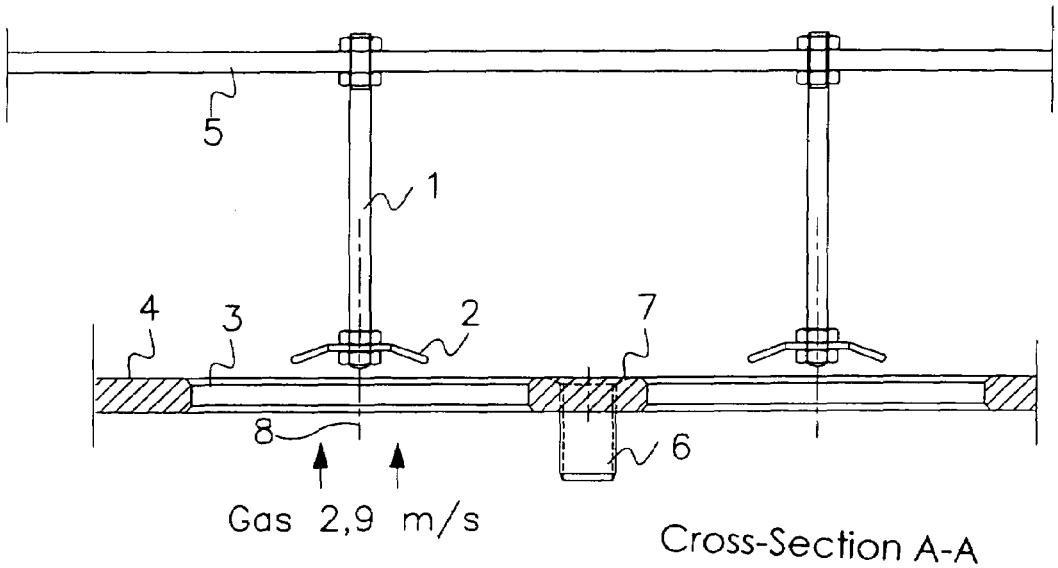
FIG. 2 is a side view of the nozzle plate with electrodes supported above the nozzle openings.

In the vertically extending gas channel, the electrically conductive plate 4 is horizontally installed. The bores 3, that is the nozzles, are arranged regularly in the embodiment shown in such a way that the center point of three adjacent bores 3 form the corners of an equilateral triangle. The axis of the small drain pipe 6 which projects from the bottom of the nozzle plate 4 is disposed in the gravity center of this triangle. The bores 3 of the nozzle plate 4 are chamfered at an angle of 30° as shown in FIG. 2. The gas flow 8 reaches the nozzle plate 4 from below and passes through the nozzles 3. Preferably, the bores are all arranged at the same distance from one another that is they are arranged at a uniform pitch. Downstream, that is above the nozzle plate 4, an electrode grid 5 is arranged at a distance from the nozzle plate 4 which is about 1½ to five times the diameter of the bore 3, and consists of a gas-permeable conductive electrode support structure 5. The electrode support structure 5 is mounted in the gas channel horizontally and supported by insulators. It is connected to a—with respect to the nozzle plate—high negative voltage (see DE 101 32 582). In a projection exactly centered on the bores of the nozzle plate 4, the electrode support structure 5 carries the center electrodes or electrode pins 1 which extend downwardly against the flow direction and toward the center point of the respective nozzle 3. The lower end of the center electrode 1 ends at a distance from the nozzle plate surface which is about 0.05 to 0.2 times the nozzle bore diameter. The lower ends of the respective center electrodes 1 are pointed or provided with star-like radial projections wherein the individual projections extend from the longitudinal axis of the respective electrode pin 1 at an angle of 60–90°. The diameter of the circle defined by the star-like radial projections is about 0.1 to 0.9 times the nozzle diameter. The number of the star-like projections corresponds about to the bore circumference in mm divided by 10 to 50 mm so that, rounded, a whole number is formed. Uneven numbers are preferred. The connecting structure for the high voltage electrodes 1, 2, 5 is, in the present case, removable. The electrode pin 1 is bolted with one end to the electrode supported structure and the star 2 is mounted to the other free end of the electrode pin 1.

The dimensions given here are exemplary:

| | |
|---|---|
| Bore diameter | 48 mm |
| Plate thickness | 5 mm |
| Star diameter | 20 mm |
| Distance between nozzle plate and star | 3 mm |
| Number of tips | 7 |
| Gas flow speed | 2.9 m/sec |
| Temperature | 75° C. |
| Gas moisture content | 50 vol % |
| High voltage | 13 kV |
| Current | 120 μA |
| Power | 1.6 watt |
| Specific power | 0.085 $Wh/m^2$ |

If, in accordance with the above example, 600 $Bm^3/h$ of wet gas is conducted through 85 nozzles with a diameter of 48 mm, the average nozzle gas flow speed is 2.9 m/sec and, with a seven tip star electrode of a tip-to-tip diameter of 20 mm, the maximum voltage is 13 kV with an about 120 μA ionization current per nozzle corresponding to a total current flow of 10 mA. Per $Bm^3/h$ gas flow volume, 0.81 watts can be introduced. Because of the relatively low gas flow speed, the water film at the nozzle edge is not pushed upwardly, and accordingly the high voltage can be increased to the value as needed for the ionization without causing arcing.

Figure 3:
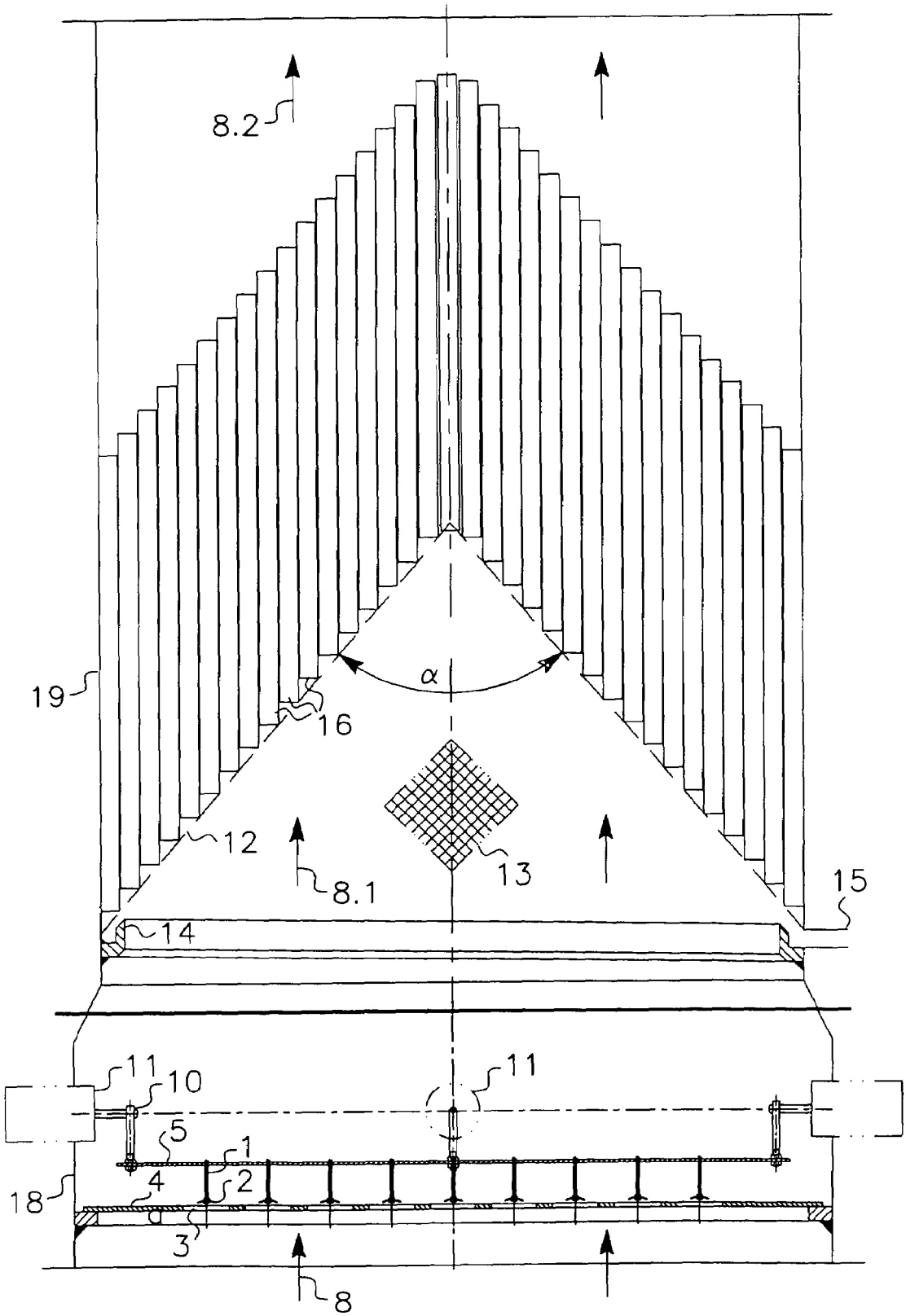
FIG. 3 shows an ionization structure in a gas flow passage.

Since then also greater droplet concentrations in the gas flow of up to about 2.000 $mg/m^3$ with a maximum droplet diameter of up to about 0.3 mm can pass upwardly through the ionization stage without causing premature arcing, a droplet removal stage as shown in FIG. 3 is provided.

Figure 1:
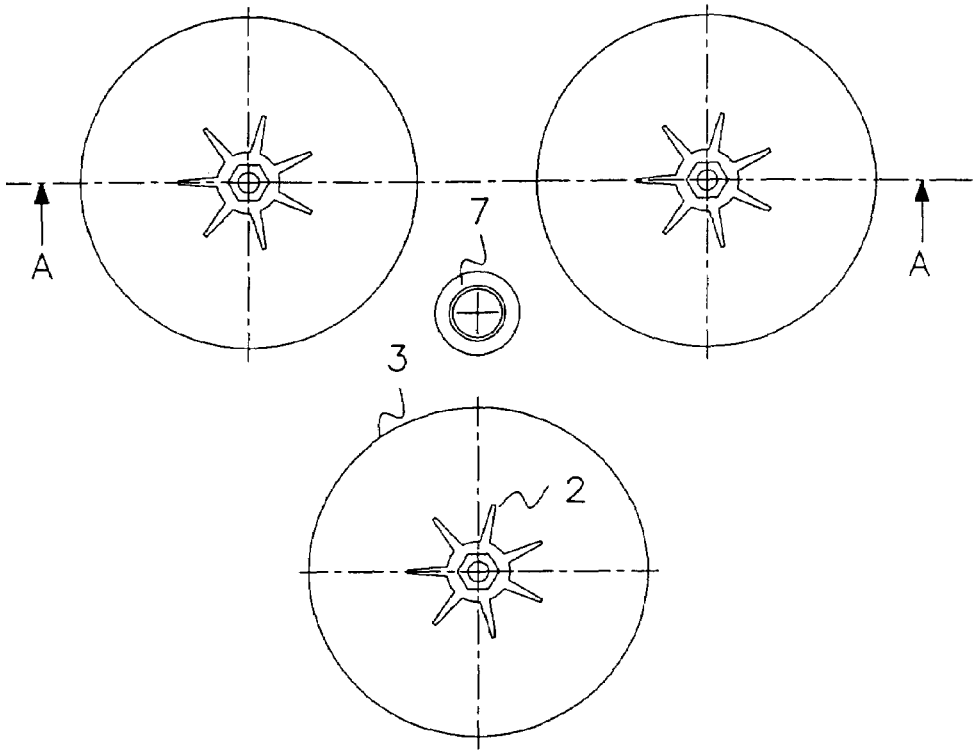
FIG. 1 is a top view of three adjacent nozzles of a nozzle plate.

FIG. 3 shows the ionization stage of FIGS. 1 and 2 arranged in the vertical channel section 18. Downstream of the channel section 18 that is the ionization stage, there is a channel section 19 with an inwardly upwardly extending cone or pyramid-shaped support grid (12 in cross-section, 13 in top view) on which the separation tubes combined to a tube bundle are supported. At the lower end of the support structure 12, 13 at the circumference thereof, a drain gutter 14 is provided which is slightly inclined (in the figure downwardly to the right) by which the water dripping from the tubes and collected by the support structure and conducted to the channel wall 19 is carried away. From the gutter 14, the collected water enters a drain 15 and is conducted, loaded with solid particles and absorbed gases and vapors, out of the apparatus. The pyramid or cone angle α is preferably smaller than 90°. The support grid structure 12, 13 is preferably square or rectangular and the individual grid straps are not horizontal but preferably extend at an angle of 45° to the horizontal and vertical planes.

The numeral 8.1 indicates the flow of gas carrying electrically charged droplets after passing the ionization stage. The numeral 8.2 indicates the purified gas flow leaving the apparatus free from the droplets and from contaminants.

The electrically insulated mounting structure 11 for the support 10 of the electrode support grid 5 has been described earlier. The desired droplet concentration in the gas can be achieved by the injection of spray water into the gas flow up-stream of the ionization stage. The pure water can physically absorb obnoxious contamination gases and vapors such as HCl or $NO_x$. If a soluble or non-soluble basic reactant is admixed to the clean water also many other acid objectionable gases such as $SO_2$ can be chemically absorbed or adsorbed.

What is claimed is:

1. An ionizer in an exhaust gas purification system for moisture-laden gases flowing through a channel (19), comprising: a nozzle plate (4) supported in said channel (19) so as to extend transversely thereacross, said nozzle plate (4) consisting of an electrically conductive material connected to a reference potential and having circular nozzle openings (3), which are uniformly distributed over the nozzle plate (4) and through which a raw gas flow (8) is conducted, a high voltage electrode support grid (5) arranged in the channel (19) downstream of the nozzle plate (4) and supported so as to be electrically insulated thereto, electrode pins (1) mounted on the electrode support grid (5) in an array corresponding to that of the nozzle openings (3) in the nozzle plate (4) and extending toward the respective nozzle openings (3), each electrode pin (1) carrying at its free end adjacent the respective nozzle opening (3) a star-structure with a number of tips uniformly distributed around the star-structure and having a uniform length and extending essentially radially from the electrode pin (1) toward the circumference of the nozzle openings but at an electrical isolation distance therefrom, said nozzle plate (4) and the high voltage electrode structure (5) as well as the electrode pins (1) and star structure (2) consisting of an electrically conductive material which is inert with respect to the gas conducted through the channel (19).

2. An ionizer according to claim 1, wherein the gas flow through the channel (19) is in an upward direction against the gravity forces.

3. An ionizer according to claim 2, wherein the nozzle openings (3) are selected to be sufficiently large so that the average flow speed of the gas in the nozzle opening (3) is less than 4 m/sec.

4. An ionizer according to claim 3, wherein the nozzle openings (3) are chamfered at their entrance and exit ends.

5. An ionizer according to claim 4, wherein tubes (6) of a dielectric material with little wall adhesion for water are arranged in the nozzle plate (4) in the center between every three adjacent nozzle openings, the tubes (6) extending from the top side of the nozzle plate (4) through the nozzle plate (4) and project downwardly from the bottom side of the nozzle plate (4) for a distance up to 10 times the nozzle plate thickness.

6. An ionizer according to claim 4, wherein, in the entrance area of the tubes (6), the nozzle plate (4) is provided with a chamfer (7) having an angle of up to 30°.

7. An ionizer according to claim 6, wherein the component structure comprising the high voltage electrode support grid (5) and the electrode pins (1) with the electrode star structure (2) forms a preassembled unit.

8. An ionizer according to claim 1, wherein the ionizer is arranged in the flow channel (19) upstream of one of a filtering unit and tube bundle water separator with conical inlet configuration for the processing moisture-laden air from drying processes and exhaust gases from combustion processes which moisture-laden air and gases include also droplet clusters.

* * * * *